United States Patent [19]

Payne, Sr.

[11] Patent Number: 5,041,030

[45] Date of Patent: Aug. 20, 1991

[54] AUTOMATIC SWITCH FOR TROLLING MOTOR DEPTH FINDER

[76] Inventor: Gerald V. Payne, Sr., 811 S. Beech Ave., Andrews, S.C. 29510

[21] Appl. No.: 577,471

[22] Filed: Sep. 4, 1990

[51] Int. Cl.[5] ..... B63H 21/17; B63H 21/26

[52] U.S. Cl. ..... 440/2; 440/6; 440/63

[58] Field of Search ..... 440/2, 6, 7, 62, 63; 181/124; 367/99, 108, 111, 165, 173

[56] References Cited

U.S. PATENT DOCUMENTS

| | | | |
|---|---|---|---|
| 3,674,228 | 7/1972 | Horton | 440/62 X |
| 3,881,443 | 5/1975 | Hamp | 440/6 X |
| 3,930,461 | 1/1976 | Brock et al. | 440/62 X |
| 3,948,204 | 4/1976 | Brock et al. | 440/6 |
| 4,109,405 | 8/1978 | Ito | 43/17.5 |
| 4,152,690 | 5/1979 | Veatch | 340/8 |
| 4,861,291 | 8/1989 | Koike | 440/1 |
| 4,926,399 | 5/1990 | Hickman | 367/173 |

*Primary Examiner*—Sherman Basinger
*Attorney, Agent, or Firm*—Michael A. Mann

[57] ABSTRACT

An automatic switch for turning off the depth finder of a trolling motor by the movement of the trolling motor from the trolling position to the folded, stowed position. The switch may open on the movement of the trolling motor out of the trolling position or into the stowed position. Preferably, the switch is a pushbutton attached to one of the two frame sections of the trolling motor in such a way that the pushbutton is depressed by engagement with the other section when the trolling motor is moved to the stowed position.

16 Claims, 2 Drawing Sheets

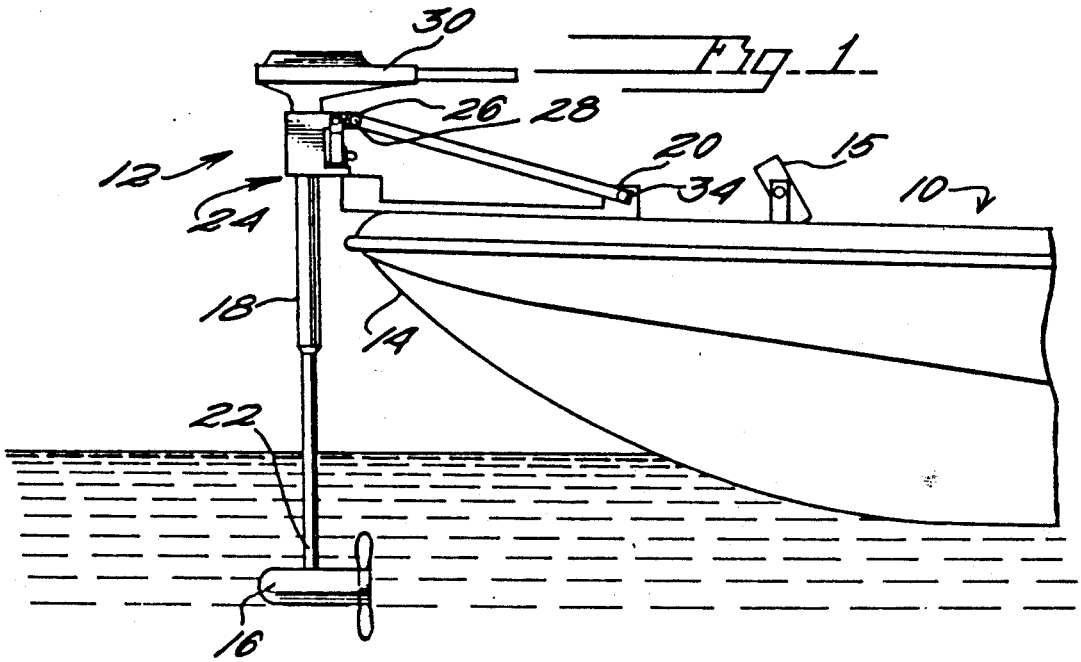
Fig. 1
Fig. 3
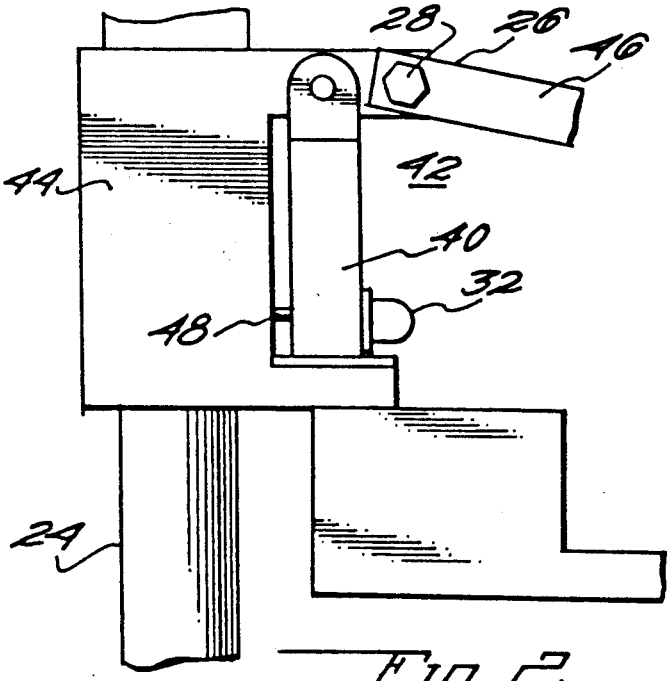
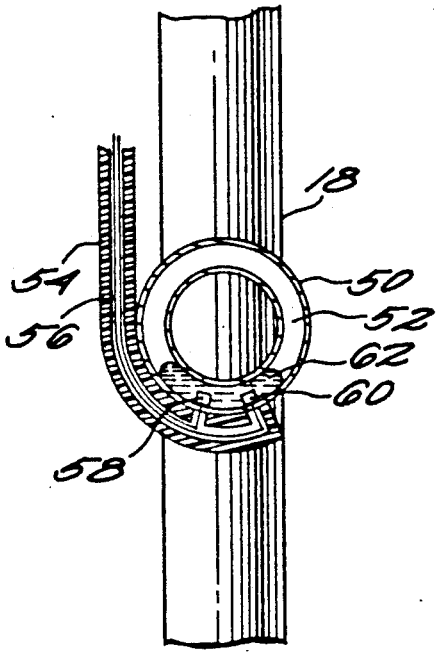
Fig. 2

AUTOMATIC SWITCH FOR TROLLING MOTOR DEPTH FINDER

BACKGROUND OF THE INVENTION

1. Field of the Invention

The present invention relates to trolling motor depth finders and, more particularly, to an automatic switch for activating a depth finder.

2. Discussion of Background

A typical fishing boat is propelled through the water by an outboard engine located in the stern of the boat. Many fishing boats also have a trolling motor mounted at the bow on a folding frame for maintaining position of a boat against a current, near a river bank or in making small adjustments in the position of the boat while its occupants are fishing. The trolling motor is typically activated by pressing a foot pedal so that the fisherman does not have to put his rod down to activate the trolling motor. When not in use, the trolling motor is folded and stowed in a generally horizontal position on the bow deck. In use, the trolling motor is unfolded and placed in the water.

Usually the boat will have a depth finder as part of its instrumentation package, along with speedometer, gasoline gauge, oil pressure gauge, and so forth. This depth finder is designed to determine the depth of the body of water as the boat is propelled by the engine. Frequently, the trolling motor will also have a depth finder transducer carried in the motor head for detecting the presence of surfaces in the water, including the presence of fish.

In fishing, the boat is propelled by the engine to a likely fishing location with the engine. The engine is turned off and the trolling motor moved from its stowed position to its trolling position. The trolling motor is in its stowed position when its frame is folded with the motor head and depth finder transducer out of the water. The trolling motor is in its trolling position when unfolded with the motor head and depth finder transducer in the water. Fishing lines are then cast and the position of the boat maintained using the trolling motor. The depth finder transducer of the trolling motor is switched on at its control panel and the sensitivity selected for the depth of water at that location. When the fisherman decides to move to a different location or to return to the dock, he switches off the depth finder, moves the trolling motor from the trolling position to the stowed position, secures it, starts the engine and departs.

If the fisherman forgets to turn the trolling motor depth finder off, he will have to go to the front of the boat and turn it off. Moving about in a boat is a little precarious because of the inherent instability of a small boat on water where every movement increases the likelihood of an accident. If he completely forgets that he has left the depth finder on, there may be interference between the depth finder of the trolling motor and the depth finder of the boat itself. Both operate by transmitting an ultrasonic signal and listening for the echo of that signal from a surface. A transmitted signal from one depth finder can be interpreted as the echo from the other, leading to erroneous depth information.

Finally, as part of the depth finder of the trolling motor, the sensitivity switch associated with the on/off control of the depth finder. The sensitivity control is set for the depth of water where the fishing is taking place. A fisherman usually has favorit places to fish where the water depth is known to him. Each time he moves to that spot, the fisherman resets the snsitivity of the depth finder for that location.

SUMMARY OF THE INVENTION

According to its major aspects, the present invention is an automatic switch for the depth finder of a trolling motor. The switch comprises means for activating and deactivating the depth finder by the movement of the trolling motor between its trolling position to its stowed position. The switch can deactivate the depth finder when the trolling motor is moved from the trolling position or when the trolling motor is moved into the stowed position or between the trolling position and the stowed position. The switch is preferably a pressure switch attached to one of the two sections comprising the frame of the trolling motor. When the two sections are folded together, the second section engages a switch mounted on the first. Alternatively, the switch can be emobodied in a mercury switch that breaks contact when the mercury moves by gravity away from a position where it is bridging a gap between two contacts by the rotation of the trolling motor from the vertical trolling position to the horizontal, stowed position.

A feature of the present invention is that the switch will operate automatically to turn off the depth finder of the trolling motor by the movement of the trolling motor from the trolling position to the stowed position. The advantage of this feature is that the acts of turning on the depth finder and stowing the trolling motor are combined into one, namely, stowing the trolling motor. Another advantage of this feature is that the trolling motor depth finder and the boat depth finder will not interfere between the depth finder of the trolling motor will be off when the trolling is in the stowed position.

Another feature of the present invention is that the movement of the trolling motor from the stowed position to the trolling position automatically turns on the depth finder. An advantage of this feature is that the sensitivity of the depth finder, once set, does not have to be reset when the fisherman returns to his fishing spot and moves the trolling motor into trolling position; the switch will automatically activate the depth finder with the sensitivity selected from previous use.

These and other features and advantages of the present invention will be apparent to those skilled in the art of trolling motor depth finders from a careful reading of the following detailed description and the accompanying drawings.

BRIEF DESCRIPTION OF THE DRAWINGS

In the figures,

FIG. 1 shows a side view of the front end of a fishing boat with a trolling motor in the trolling position and an apparatus according to a preferred embodiment of the present invention;

FIG. 2 shows a detailed view of the apparatus of FIG. 1;

FIG. 3 shows a cross sectional side view of an alternate embodiment of the present invention;

DETAILED DESCRIPTION OF PREFERRED EMBODIMENTS

Figure 4:
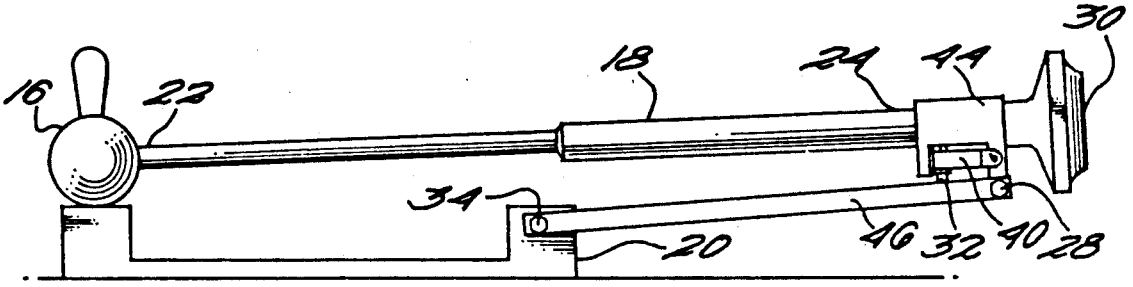
FIG. 4 shows trolling motor in the stowed position with the embodiment of the invention of FIGS. 1 and 2.

Referring now to FIG. 1, a fishing boat 10 has a trolling motor 12 attached to its bow 14. Trolling motor 12 has a motor head 16 and several interconnected frame sections. On bow 14 is a depth finder 15 which is connected to a transducer (not shown) carried by motor head 16. There is a first frame section 18 and a second frame section 20. A first end 22 of the first frame section 18 carries motor head 16; a second end 24 of first frame section 18 is pivotally attached to a first end 26 of second frame section 20 by a first pivot pin 28. Trolling motor 12 has a tiller 30 and a pushbutton switch 32.

FIG. 1 shows trolling motor 12 in trolling position; that is, trolling motor 12 is in operation with motor head 16 in the water and trolling motor 12 generally vertical. FIG. 4 shows trolling motor 12 in stowed position, with motor head 16 out of the water and trolling motor 12 generally horizontal. To move trolling motor 12 from the trolling position to the stowed position requires the lifting of trollling motor up, out of the water and onto boat 10, pivoting trolling motor about pivot pin 28 and a second pivot pin 34, thereby bringing first section 18 and second section 20 together in near parallel arrangement as shown in FIG. 4.

FIG. 2 shows a detailed view of pushbutton switch 32. Pushbutton switch 32 is held by a button bracket 40 within a recess 42 in a first section mounting bracket 44 that is secured to first frame section 18 just below tiller 30. Mounting bracket 44 specifically and trolling motor 12 generally are held by second section 20 and by a connecting rod 46, which is part of second section 20. Pushbutton switch 32 is connected by a cable 48 in series with the power supply of boat 10 and the depth finder of trolling motor 12. When pushbutton switch 32 is depressed by engagement with second frame section 20, the circuit between the depth finder and the power supply is open.

FIG. 3 shows an alternative embodiment of the present invention. Mounted to first section 18 is a nonconducting disk 50 with a circumferential passage 52 therein. A cable 54 carries a pair of wires 56 to first and second contacts 58 and 60. First contact is connected to the depth finder of trolling motor 12; second contact 60 is connected to the power supply of boat 10. Inside circumferential passage 52 is a small quantity of mercury 62 or other conductor that is free to move in response to gravity, such as another liquid conductor or a plurality of metal balls or cylinders. When trolling motor 12 is in the trolling position, first section 18 is generally vertical and mercury 62 bridges the gap between first and second contacts 58 and 60. When trolling motor 12 is moved from the vertical position, and mercury 62 moves gravitationally off first or second contacts 58, 60, or both, the gap therebetween is not spanned and thus the circuit between the power supply and trolling motor 12 is open.

FIG. 4 shows trolling motor 12 in stowed position, with first frame section 18 and second frame section 20 in near parallel arrangement and pushbutton switch 32 engaging second section 20 and being depressed thereby. In this embodiment, the circuit is broken when trolling motor 12 is horizontal but contact is made when trolling motor 12 is moved from the horizontal position and pushbutton switch 32 is no longer depressed by second frame section 20.

Figure 5:
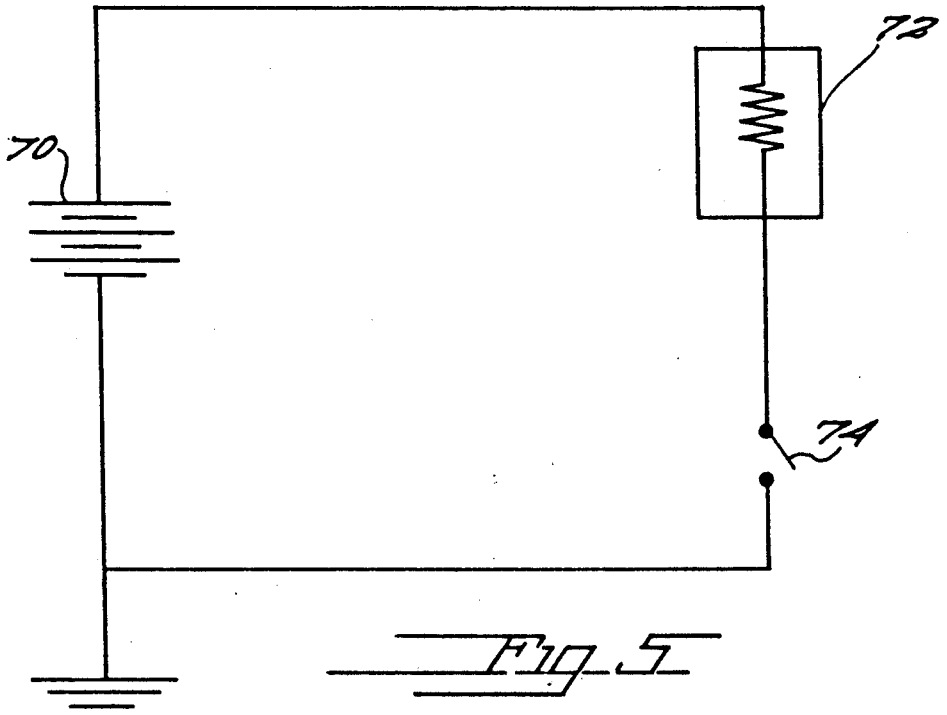
FIG. 5 is a schematic of the electrical connections between the present invention, trolling motor and power supply.

FIG. 5 shows the present invention in an electrical schematic. Boat 10 has a power supply 70 and depth finder 72 in series with a switch 74, which, when open, deactivates depth finder 72. When switch 74 is closed, depth finder 72 is activated.

Other embodiments of the present invention are also possible, such as an electric eye that senses movement of the trolling motor passed a fixed point on the boat or pressure sensor in motor head 16 that activates the depth finder when the pressure of the water closes the switch.

It will be apparent from the foregoing description of preferred embodiment of the invention, that many modifications can be made to the embodiments described without departing from the spirit and scope of the invention, which to be defined by the appended claims.

What is claimed is:

1. An apparatus for use with a depth finder of a trolling motor, said depth finder having a power supply, said trolling motor having a trolling position and a stowed position, said apparatus comprising:

switch means in series with said power supply and said depth finder for activating and deactivating said depth finder, said switch means having an open position and a closed position, said closed position activating said depth finder and said open position deactivating said depth finder, said switch being switched from said closed position to said open position by movement of said trolling motor from said trolling position to said stowed position and said open position to said closed position by movement of said trolling motor from said stowed position to said trollling position.

2. The apparatus as recited in claim 1, wherein said switch is switched from said closed position to said open position upon movement of said trolling motor from said trolling position.

3. The apparatus as recited in claim 2, wherein said trolling motor is generally vertical when in said trolling position and said switch means is in said open position when not generally vertical and in said closed position when vertical.

4. The apparatus as recited in claim 3, wherein said switch means further comprises:

a first contact in electrical connection with said depth finder; and a second contact in electrical connection with said power supply, said first and said second contact having a gap therebetween and conducting means for bridging said gap, said conducting means moving in response to gravity to span said gap when said trolling motor is generally vertical and not spanning said gap when said trolling motor not generally vertical.

5. The apparatus as recited in claim 1, wherein said switch means is switched from said closed position to said open position upon moving said trolling motor into said stowed position.

6. The apparatus as recited in claim 5, wherein said trolling motor is generally horizontal when in said stowed position and said switch means is in said closed position when not generally horizontal and in said open position when horizontal.

7. The apparatus as recited in claim 6, wherein said trolling motor further comprises a motor head, a first frame section carrying said motor head and a second frame section pivotally attached to said first frame section so that said first and said second frame sections can be folded together in near parallel arrangement, said first and second frame sections folded together when said trolling motor is in said stowed position and unfolded when said trolling motor is in said trolling position, said switch means further comprising a pushbutton switch mounted to said first frame section so that said pushbutton engages and depresses said second section when said series of frame sections is folded.

8. The apparatus as recited in claim 6, wherein said switch means further comprises:

a first contact in electrical connection with said depth finder; and a second contact in electrical connection with said power supply, said first and said second contacts having a gap therebetween, and conducting means for bridging said gap, said conducting means moving in response to gravity to span said gap when said trolling motor is not generally horizontal and not spanning said gap when said trolling motor is generally horizontal.

9. An apparatus for use with a boat having a power supply, said apparatus comprising in combination:

a trolling motor;

a depth finder carried by said boat, said depth finder electrically connected to said power supply, said trolling motor having a trolling position and a stowed position; and switch means in series with said power supply and said depth finder for activating and deactivating said depth finder, said switch means having an open position and a closed position, said closed position activating said depth finder and said open position deactivating said depth finder, said switch being switched from said closed position to said open position by movement of said trolling motor from said trolling position to said stowed position and said open position to said closed position by movement of said trolling motor from said stowed position to said trolling position.

10. The apparatus as recited in claim 9, wherein said switch is switched from said closed position to said open position upon movement of said trolling motor from said trolling position.

11. The apparatus as recited in claim 10, wherein said trolling motor is generally vertical when in said trolling position and said switch means is in said open position when not generally vertical and in said closed position when vertical.

12. The apparatus as recited in claim 11, wherein said switch means further comprises:

a first contact in electrical connection with said depth finder; and a second contact in electrical connection with said power supply, said first and said second contact having a gap therebetween and conducting means for bridging said gap, said conducting means moving in response to gravity to span said gap when said trolling motor is generally vertical and not spanning said gap when said trolling motor not generally vertical.

13. The apparatus as recited in claim 9, wherein switch means is switched from said closed position to said open position upon moving said trolling motor into said stowed position.

14. The apparatus as recited in claim 13, wherein said trolling motor is generally horizontal when in said stowed position and said switch means is in said closed position when not generally horizontal and in said open position when horizontal.

15. The apparatus as recited in claim 14, wherein said trolling motor further comprises a motor head, a first frame section carrying said motor head and a second frame section pivotally attached to said first frame section so that said first and said second frame sections can be folded together in near parallel arrangement, said first and second frame sections folded together when said trolling motor is in said stowed position and unfolded when said trolling motor is in said trolling position, said switch means further comprising a pushbutton switch mounted to said first frame section so that said pushbutton engages and depresses said second section when said series of frame sections is folded.

16. The apparatus as recited in claim 14, wherein said swith means further comprises:

a first contact in electrical connection with said depth finder; and a second contact in electrical connection with said power supply, said first and said second contacts having a gap therebetween, and conducting means for bridging said gap, said conducting means moving in response to gravity to span said gap when said trolling motor is not generally horizontal and not spanning said gap when said trolling motor is generally horizontal.

* * * * *